United States Patent [19]

Yokoyama et al.

[11] Patent Number: 5,030,510

[45] Date of Patent: Jul. 9, 1991

[54] FRESHNESS PRESERVATIVE PACKING MATERIAL FOR FOODSTUFFS AND METHOD OF FIXING THE FRESHNESS PRESERVATIVE SUBSTANCE ONTO THE PACKING MATERIAL

[75] Inventors: Yoshimasa Yokoyama, 104, No. 5-3, Sumiyoshi-higashicho 2-chome, Higashicho-ku, Kobe-shi; Mikio Hanioka, Omihachiman, both of Japan

[73] Assignees: Nippon Danbohru Co., Ltd.; Yoshimasa Yokoyama, both of Japan

[21] Appl. No.: 339,844

[22] Filed: Apr. 18, 1989

[30] Foreign Application Priority Data

Apr. 20, 1988 [JP] Japan ..... 63-97562

[51] Int. Cl.[5] ..... B32B 3/26

[52] U.S. Cl. ..... 428/305.5; 427/5; 427/245; 427/256; 427/385.5; 428/317.9

[58] Field of Search ..... 427/428, 427, 429, 256, 427/245.5, 385.5; 428/317.9, 305.5; 252/194; 502/406; 206/524.2-524.4

*Primary Examiner*—Bernard Pianalto

*Attorney, Agent, or Firm*—Lorusso & Loud

[57] ABSTRACT

A packaging material for packing boxes, packing bags and wrapping paper characterized in that a surface of the packaging material is coated with an air pervious tight coating. The coating partially or entirely covers the surface intended for contact with the wrapped contents, and contains grains or minute particles of a freshness preservative substance which is a far-infrared radioactive substance emitting radiation of a wave length of about 3-4 μm at room temperature, a gas adsorptive substance, a substance reactive with oxygen at room temperature or a mixture thereof.

Also disclosed is a method of fixing the freshness preservative substance on a packaging material characterized by printing, coating or spraying a coating onto a surface of the packaging material that is to be contacted with the wrapped contents. The coating is a liquid solution of a coating formative substance containing, dispersed therein, solid grains or minute particles of a freshness preservative substance which is a far-infrared radioactive substance emitting radiation of a wave length of about 3-14 μm at room temperature, a gas adsorptive substance, a substance reactive with oxygen at room temperature or a mixture thereof.

5 Claims, 1 Drawing Sheet

FRESHNESS PRESERVATIVE PACKING MATERIAL FOR FOODSTUFFS AND METHOD OF FIXING THE FRESHNESS PRESERVATIVE SUBSTANCE ONTO THE PACKING MATERIAL

BACKGROUND OF THE INVENTION

1. Field of the Invention

The present invention relates to a packaging material capable of preserving freshness of foodstuffs, above all perishables, that may be formed into boxes, bags, wrapping paper, and the like and to a method of fixing the freshness preservative substance onto the packaging material by means of physical and/or chemical processing to preserve freshness as long as possible.

2. Description of the Prior Art

A known wrapping film is manufactured through the process of dispersing minute particles into the film material by crushing and comminuting a solid substance which emits far-infrared rays of about 3–14 μm at room temperature as, for example, far-infrared radioactive ceramics. Products such as packing bags made of this film and packing boxes covered by this film are available in the market. Vegetables, meat, fish and other foodstuffs in fresh condition wrapped by this film are believed to be preserved in freshness longer as packed therein by virtue of absorption of the far-infrared rays radiated from the minute particles in the film.

Further, such corrugated cardboard boxes are available in the market having interiors covered by cristobalite-containing thin paper that is manufactured by mixing the paper material with minute particles of cristobalite capable of gas adsorption. When packed in these corrugated cardboard boxes, the freshness of vegetables and fruit are preserved longer by virtue of the cristobalite minute particles which absorb ethylene gas emitted from the fresh vegetables and fruit themselves. The mechanism is that when the fresh vegetables and fruit are put into contact with the ethylene gas that they, themselves emit, the gas quickens their breathing pace and thus more energy is exhausted and maturity is accelerated resulting in earlier decay. On the other hand, when the ethylene gas is adsorbed by an adsorptive substance and kept away from the vegetables and fruit, such deleterious effects are eliminated and freshness is better preserved.

When a substance which is oxygen-reactive at room temperature, such as iron, aluminum, copper and ascorbic acid, is sealed up by a packaging material together with foodstuffs, the decay of the foodstuffs is suppressed as said substance takes up oxygen inside and thus results in longer preservation of the freshness. However, such wrapping material has never been proposed.

In order to disperse the far-infrared radioactive minute particles into the polyethylene film, it is necessary to mix the minute particles with the resin liquid during the manufacturing of the film, however, achievement of an even and uniform dispersion of the minute particles overall is very difficult and, further, the manufacturing of the film itself becomes time-consuming, thus the manufacturing cost is inclined to be increased because of the presence of the minute particles. Moreover, when the film is used for packing boxes, it should always be placed over the inside surface and, as a result, processing cost may be further increased.

The cristobalite-containing thin paper, on the other hand, requires another sort of bothersome processing procedure of paper making with the cristobalite minute particles, which is timeconsuming. Further the cristobalite-containing thin paper is required to be applied to boxes over the inside surface of boxes, which further increases the manufacturing cost. Further, this cristobalite-containing thin paper suffers from the defect of the minute particles falling off.

SUMMARY OF THE INVENTION

A purpose of the present invention is to provide a packaging material, such as packing boxes, packing bags and wrapping paper, that retains a freshness preservative substances evenly, uniformly overall, without any tendency of the preservative to fall off from the package surface and come in contact with the wrapped contents.

Another purpose of the present invention is to propose a method to fix the freshness preservative substance onto a packaging material at a lower cost than heretofore possible.

Another purpose of the present invention is to propose a method to fix the freshness preservative substance onto the packaging material more evenly, uniformly overall without tendency to fall off.

Other purposes of the present invention and advantages expected therefrom will be explained in the following.

According to one embodiment of the present invention, a packaging material for packing boxes, packing bags and wrapping paper is in the form of an air permeable tight coating which partially or entirely separates the contact surface of the wrapping from the contents. The coating retains dispersed grains or minute particles of a freshness preservative substance containing at least one of a far-infrared radioactive substance emitting about 3–14 μm wave length at room temperature, a gas adsorptive substance and a substance oxygen reactive at room temperature.

According to another aspect of the invention, a method of fixing the freshness preservative substance onto the packing material is proposed, which method involves printing, coating or spraying over the packing material a liquid dispersion of grains or minute particles of freshness preservative substance containing one or more of a radioactive substance which emits far-infrared rays having about 3–14 μm wave length at room temperature, a gas adsorptive substance and a substance reactive at room temperature. The particles are dispersed in a solution containing a coating formative substance and the solvent is removed by drying the resultant coating.

By mixing the minute particles of freshness preservative substance with the solution of a coating formative substance, the liquid dispersion with the said minute particles evenly and uniformly dispersed therein is obtained, then the liquid dispersion is printed, coated or sprayed over a surface of the packaging material which it to contact the contents, and then dried. Thus the coating formative substance solidifies over the surface, with the minute particles or grains of freshness preservative substance are evenly and uniformly dispersed overall therein, to form a coating.

This coating, formed in intimate contact with the packaging material, strongly adheres to the coated surface and has air permeability, i.e. it is only slightly a gas barrier. Because not formed as a lining over the interior surface of a box, this approach is less costly yet sufficient to fix the freshness preservative substance to the packaging material.

DESCRIPTION OF THE PREFERRED EMBODIMENTS

Figure 1:
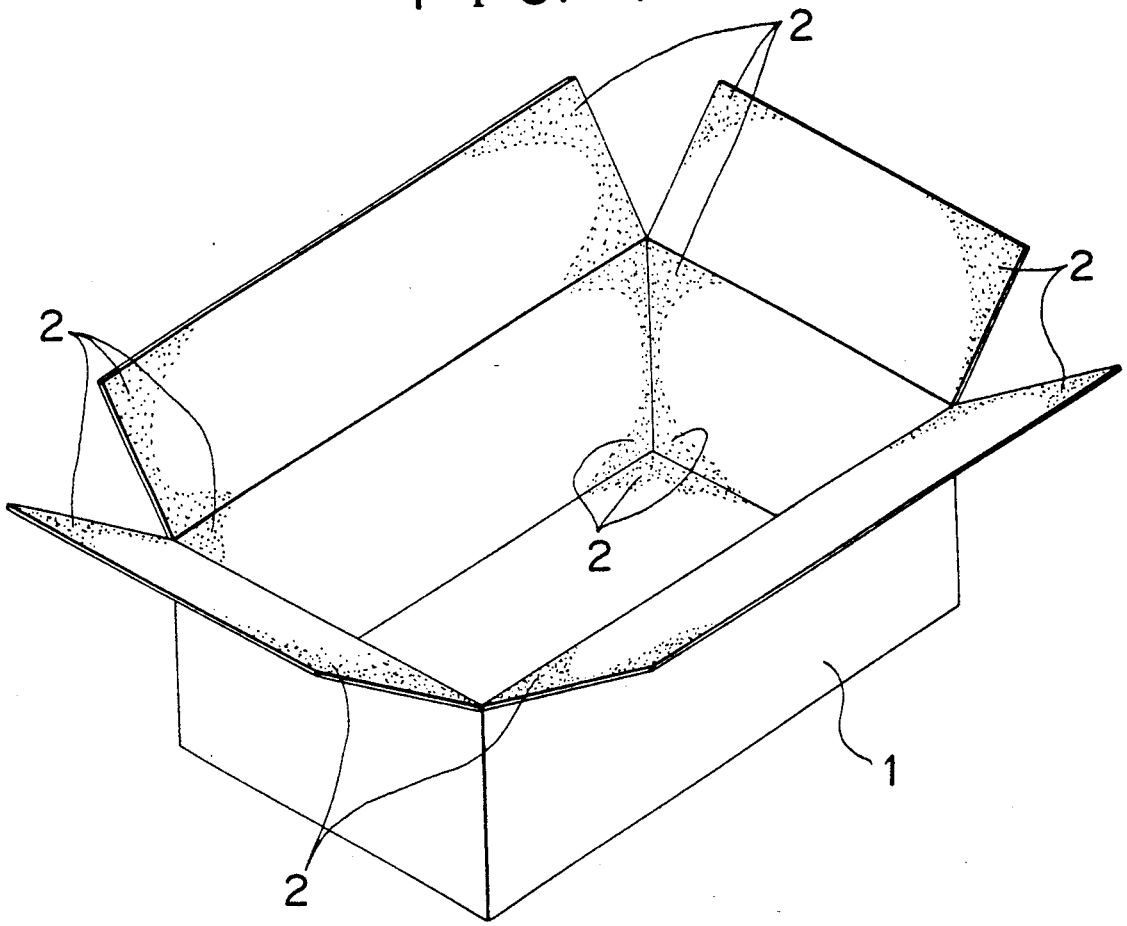
FIG. 1 is a perspective view showing an embodiment of a packing box, the inside of which has fixed thereon a freshness preservative substance by the process of the present invention.

The far-infrared radioactive substance, which serves as a freshness preservative substance, is, for example, a mineral such as zirconium, zirconia, zirconium compound, etc. or a fine ceramic or the like manufactured through crushing and comminuting, mixing and calcining several kinds of these minerals. However, any substance which radiates, at room temperature, far-infrared rays of the wave length mentioned above may be used. By crushing and comminuting the fine ceramics, or calcining at a high temperature and crushing one of the several kinds of minerals mentioned above, the minute particles of the far-infrared radioactive substance can be obtained.

In other embodiments a gas adsorptive substance is used as the freshness preservative substance, for example, a porous mineral such as cristobalite, sepiolite, zeolite, composite zeolite and the like or silica gel, etc. However, any substance which adsorbs gas may be used.

Substances reactive with oxygen at room temperature represent another type of freshness preservative substance, for example, an easily oxidizable metal such as iron, aluminum, copper, etc. and also ascorbic acid, sodium ascorbate, etc. However, any substance which reacts to oxygen at room temperature may be used. The ascorbic acid and sodium ascorbate can be used, after dissolved in water, by having them adsorbed into the powder of a porous adsorptive substance.

The most suitable fineness or particulate size for the minute particles of one or several kinds of freshness preservative substance will be decided on the basis of the nature of the packaging material, the nature of the contents packed, the layer thickness of the coating of the freshness preservative substance, the kind of solvent used and other various factors. Generally speaking, it is preferable to use minute particles of about 0.1–5 μm.

The comminuted freshness preservative substance is mixed with and dispersed into a solution containing a coating formative substance. A solvent for the coating formative substance can either be water, an organic solvent or a mixture of water and an organic solvent. The most suitable kind of solvent is decided on the basis of the nature and/or kind of the freshness preservative substance, the nature of the contents to be packaged and other various other factors. For example, when minute particles of a metal chemically reactive with oxygen at room temperature are used, an organic solvent must be selected because the particles, if mixed with a solution containing water, would be rapidly oxidized. When water is selected as the solvent for the coating formative substance, it is preferred to mix a small amount of emulsifyinq stabilizer and/or thickener such as adhesive polysaccharides including xanthin gum, etc. and sepiolite etc., and in cases where the emulsifying stabilizer and/or thickener have or has a corrosiveness and/or susceptability to fungal attack it is preferable to add a very small amount of antiseptic. When an organic solvent is selected as the solvent, it is preferred to select an organic solvent having a volatility which ensures that removal and recovery from the surface of packaging material will quickly and certainly take place.

For such an organic solvent, any of the following will be preferably used:

Ethanol, limonene, toluene, ethyl acetate, xylene, carbinol, benzene, methanol, isopropyl alcohol, butanol, methylenechloride, ethylene-chloride, methyl acetate, ethyl acetate, butyl acetate, methyl cellosolve, acetone, ketone, cyclohexane, etc.

Any coating formative substance capable of dissolving in a solvent and solidifying upon removal of the solvent, by drying may be used, however, a high polymer compound is preferred, such as ethylene cellulose, hydroxy-propyl-cellulose, acrylic resin, polyvinyl (PVP), etc.

Fixation to a packaging material by the liquid dispersion of minute particles of freshness preservative substance is attained by such a process such as printing, coating or spraying, etc. The coating may be done using rollers or brushes, etc., while the printing may be done by screening, flexgraphy and any other available techniques. The fixation onto a packaging material of the liquid dispersion with the minute particles of the freshness preservative substance dispersed therein can as well be effectively on only a part of the packaging material, not necessarily the entire surface to be contacted by the packed contents. As for the layer thickness of the coating that is formed over a packaging material with the liquid dispersion with the minute particles of the freshness preservative substance dispersed therein, any can be chosen, however, it is preferable that the coating be thinner than 50 μm. After fixation of the liquid dispersion onto a packaging material, the solvent therein is removed through a drying process. In a case where an organic solvent is used, it is preferable to volatilize and recover the same.

Thus a coating of minute particles of the freshness preservative substance that are evenly dispersed therein is formed over a packaging material and fixed thereon as above mentioned.

The coating formative substance, solidified after the solvent has been removed through the drying process, is highly gas-, e.g. air-permeable. By supplying a gas under pressure to the liquid dispersion or by using a blowing agent before printing, coating or spraying the liquid dispersion over a packaging material, the liquid dispersion is thus foamed with cells as minute as a few and minute stomata are formed throughout the coating over the packing material. By selecting the average size of the foam produced by the blowing process, that is, by choosing an average diameter for the numerous stomata formed throughout the coating, 10 the action of the minute particles of the freshness preservative substance that are contained in the coating itself can be controlled fast or slow, especially when that substance is a gas adsorptive substance or an oxygen reactive substance at room temperature.

A packing box, an embodiment of the packaging material, may be manufactured by coating or spraying the liquid dispersion for fixation onto the entire or partial inside surface of a box after assembly, however, it is more effective and economical to have the thick paper or corrugated cardboard cut into a box shape and then to print, coat or spray the liquid dispersion onto the desired surface of the packing material fixation and to assemble the box when dried. Alternatively, the liquid dispersion may be applied onto a desired surface of the packing material before cutting by printing, coating or spraying and then cutting and assembling the box after drying.

A packing bag, another embodiment of the packaging material, may be manufactured by coating or spraying the liquid dispersion onto the inside surface of the bag after shaping into a bag through assembly of a cut sheet, however, it is more effective and economical to manufacture the bag after printing, coating or spraying the liquid dispersion onto a desired surface of the material and drying.

Hereunder a few preferred embodiments of the present invention are described in more detail with some preferred embodiments of the liquid dispersion containing grains and/or minute particles of the freshness preservative substance.

EXAMPLE 1

Acrylic resin: 500 parts by weight
Water: 244 parts by weight
Adhesive polysaccharide xanthin gum: 5 parts by weight
Defoaming agent and antiseptic: 1 part by weight The above components were mixed together to prepare a solution of the coating formative substance, namely acrylic resin, with the water solvent.

Oxidized aluminum: 125 parts by weight
Zirconia: 57 parts by weight
Silica: 67 parts by weight The above freshness preservative substances were minutely comminuted into an average particulate diameter of about 0.5 um, and then mixed with the solution to make a liquid dispersion. Then the liquid dispersion with the minute particles of the fresh preservative substance in a dispersed condition was fixed onto the inside surface of a cut packing box blank, i.e. a corrugated cardboard box, by a process of screen printing to an average layer thickness of 30 μm, which after drying was assembled into a box 1 as shown in FIG. 1, the inside surface of which has the minute particles 2 of the three kinds of freshness preservative substances spread evenly overall.

Figure 2:
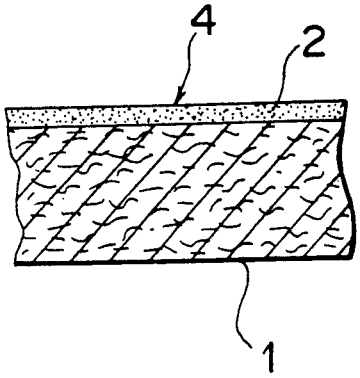
FIG. 2 is an enlarged sectional view of a part of the packing box of FIG. 1.

A coating 4 having air permeability with an average layer thickness of 17 μm was formed over the entire inside surface of a packing box 1, which coating contained the minute particles 2 composed of the above three kinds of freshness preservative substances (FIG. 2). Thus, the minute particles 2 were fixed over the entire inside surface of the packing box 1 in a substantially evenly dispersed condition. Moreover, the coating 4 containing the minute particles 2 of the freshness preservative substance remained firmly fixed thereto even when directly contacted with other articles.

EXAMPLE 2

Hydroxypropylcellulose: 250 parts by weight
Ethanol: 500 parts by weight
Antiseptic: 1 part by weight The above were mixed with an organic solvent and a solution of coating formative substance was prepared.

Oxidized aluminum: 125 parts by weight
Zirconia: 57 parts by weight
Deoxidized silicon: 67 parts by weight After comminuted into an average particulate diameter of 0.5 um, the above freshness preservative substance was added to the above solution and mixed therein to produce a liquid dispersion in an evenly dispersed condition. This liquid dispersion, which was manufactured by dispersing the minute particles of the freshness preservative substance, was fixed onto the inside surface of an unassembled packing box (corrugated cardboard box) with an average layer thickness of 25 μm through a screen printing process and then assembled into a packing box 1 after removing and recovering ethanol from the liquid dispersion and then naturally drying.

A coating 4 with an average layer thickness of 14 um with air permeability containing the minute particles 2 of the above said three kinds of freshness preservative substances was formed over the entire inside surface of the packing box 1, thus fixing the minute particles 2 substantially evenly over the inside surface of the packing box 1. Moreover, the coating 4 containing the minute particles of freshness preservative substance was firmly fixed to such an extent that it remained intact even when contacted with other articles.

EXAMPLE 3

Ethylene cellulose: 250 parts by weight
Limonene: 500 parts by weight

By mixing the above, a solution of coating formative substance with an organic solvent was prepared.

Sepiolite: 125 parts by weight
Zirconia: 57 parts by weight
Silica: 67 parts by weight The above freshness preservative substance was minutely comminuted into an average particulate diameter of 0.5 um and then mixed with the above-mentioned solution to manufacture a liquid dispersion having evenly dispersed minute particles, then air was pumped by a compressor into the liquid dispersion to produce a foam having air bubbles of an average diameter of 1 μm.

Figure 3:
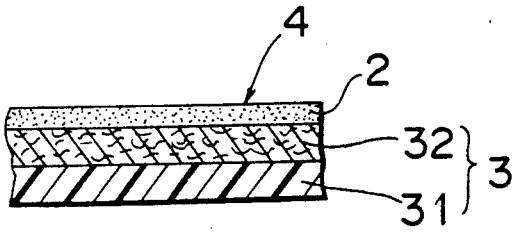
FIG. 3 is an enlarged sectional view of a sheet of wrapping paper with a freshness preservative substance fixed thereon in accordance with the present invention.

The liquid dispersion of the minute particles of the freshness preservative substance dispersed therein was applied evenly onto a wrapping sheet 3, which was composed of a polyethylene sheet 31 laminated to a paper 32 as shown in FIG. 3, in other words onto the surface of the paper 32, by a screen printing process with an average layer thickness of 10 μm. The limonane was then evaporated and recovered so that an air permeable coating containing the minute particles 2 of freshness preservative substance evenly dispersed over the entire surface was formed, thus producing a wrapping sheet 3.

The layer thickness of the coating 4 containing the minute particles 2 was about 6 μm on an average, and on this coating 4 a number of minute stomata were formed overall. The minute particles 2 were evenly and firmly fixed over the entire wrapping sheet 3.

EXAMPLE 4

Polyvinylalcohol: 250 parts by weight
Ethanol: 500 parts by weight
Minutely comminuted sepiolite: 5 parts by weight The above were mixed to prepare a solution with an organic solvent of a coating formative substance.

Iron powder: 125 parts by weight
Zirconia: 57 parts by weight
Silica: 67 parts by weight The above freshness preservative substances were minutely comminuted into an average particulate diameter of 1 μm and then mixed with and evenly dispersed in a solution prepared by the same process as mentioned above.

The liquid dispersion with the minute particles of freshness preservative substance dispersed therein was fixed onto a surface of a cut but unassembled packing box 1 using the same process as described in Example 1 so that the layer thickness thereof was about 10 μm on an average. Then the ethanol in the liquid dispersion was evaporated and recovered and the coated box blank was naturally dried and then finally assembled into a box.

The coating 4 had an average layer thickness of 6 μm and contained the minute particles 2 of freshness preservative substance fixed firmly and evenly over the inside surface of the packing box 1.

The packing box 1 of this example can preserve the freshness of packed green vegetables and fruit longer through the oxidation of the iron within the coating by taking up the oxygen in the box.

When the liquid dispersion with the minute particles of freshness preservative substance dispersed therein is to be fixed onto the inside surface of an assembled packing box 1, brushes or rollers will be used for painting or sprayers for spraying, followed by drying. The drying process can either be by use of a heater or other available process as well as natural drying.

To manufacture a packing bag, it is preferred first to fix the liquid dispersion with the minute particles of freshness preservative substance dispersed therein by either printing, coating or spraying thereon and then to remove the solvent through drying, etc. and finally to cut and assemble into a bag.

Thus the minute particles of freshness preservative substance can be fixed over packaging materials evenly, uniformly and firmly by a process which is very simple and uncostly.

What is claimed is:

1. A coated packaging material for packing boxes, packing bags or wrapping paper, said coated packaging material comprising a packaging material substrate and an air-pervious foam coating partially or entirely covering a surface of said packaging material substrate, said coating having minute stomata and containing, uniformly dispersed therein, minute solid particles of a freshness preservative selected from the group consisting of far-infrared radioactive substances which emit radiation of wave lengths of about 3–14 μm at room temperature, gas adsorptive substances, substances which react with oxygen at room temperature and mixtures thereof.

2. A coated packaging material in accordance with claim 1 produced by a process comprising:

dispersing said minute solid particles in a solvent solution of a coating formative substance to produce a coating liquid;

foaming said coating liquid;

applying said foamed coating liquid to said substrate; and drying said applied coating.

3. A method of fixing a freshness preservative substance onto a packing material for wrapped foodstuffs, said admixing a liquid containing a coating formative substance and minute solid particles of a freshness preservative substance selected from the group consisting of far-infrared radioactive substances which emit radiation of wave lengths about 3–14 μm at room temperature, gas adsorptive substances, substances which react with oxygen at room temperature and mixtures thereof to form a coating liquid;

foaming said coating liquid;

coating a surface of the packaging material that is to contact the wrapped foodstuff with said foamed liquid thereby forming a cellular coating that is air-permeable due to the presence of minute stomata.

4. The method of claim 1, wherein said liquid comprises water and wherein said coating formative substance is dissolved in said water.

5. The method of claim 1, wherein said liquid comprises solvent for the coating formative substance and said solvent is either an organic solvent or a mixture of an organic solvent and water.

* * * * *

UNITED STATES PATENT AND TRADEMARK OFFICE

CERTIFICATE OF CORRECTION

PATENT NO. : 5,030,510

DATED : July 9, 1991

INVENTOR(S) : YOKOYAMA et al

It is certified that error appears in the above-identified patent and that said Letters Patent is hereby corrected as shown below:

Col. 4, line 59, delete "10".

IN THE CLAIMS:

Col. 8, line 21, after "said" insert --method comprising:--;

line 37, "1" should read --3--; and line 40, "1" should read --3--.

Signed and Sealed this

Twenty-ninth Day of December, 1992

*Attest:*

DOUGLAS B. COMER

*Attesting Officer*

*Acting Commissioner of Patents and Trademarks*